US006533200B2

(12) United States Patent
Päper

(10) Patent No.: US 6,533,200 B2
(45) Date of Patent: Mar. 18, 2003

(54) ARRANGEMENT OF SEATS FOR KNIVES ON A CUTTING SHAFT IN A SHREDDING MACHINE

(76) Inventor: Bernd Päper, Dornechstrasse 19, Hofstetten (CH), 4114

( * ) Notice: Subject to any disclaimer, the term of this patent is extended or adjusted under 35 U.S.C. 154(b) by 0 days.

(21) Appl. No.: 09/810,806

(22) Filed: Mar. 15, 2001

(65) Prior Publication Data

US 2001/0038049 A1 Nov. 8, 2001

Related U.S. Application Data

(63) Continuation of application No. 09/310,496, filed on May 12, 1999, now abandoned.

(51) Int. Cl.[7] ..... B02C 13/28

(52) U.S. Cl. ..... 241/294; 241/277; 241/197; 241/300

(58) Field of Search ..... 241/294, 197, 241/300, 277; 83/331

(56) References Cited

U.S. PATENT DOCUMENTS

| | | | | |
|---|---|---|---|---|
| 169,654 A | | 11/1875 | Munson | 241/294 X |
| 994,264 A | | 6/1911 | MacKay | 241/294 X |
| 1,939,660 A | | 12/1933 | Campbell | 241/294 X |
| 4,561,156 A | | 12/1985 | Sun | 241/294 X |
| 4,609,158 A | | 9/1986 | Wilson | 241/300 |
| 4,915,309 A | | 4/1990 | Schmidt | 241/191 |
| 4,930,710 A | * | 6/1990 | Hench | 241/294 |
| 5,044,570 A | * | 9/1991 | Montgomery, Sr. | 144/230 |
| 5,240,192 A | | 8/1993 | Tilby et al. | 241/292.1 |
| 5,381,976 A | * | 1/1995 | Chon et al. | 241/197 |

FOREIGN PATENT DOCUMENTS

| | | |
|---|---|---|
| DE | 930839 | 7/1955 |
| EP | 266447 | 5/1988 |
| FR | 1077342 | 11/1954 |

* cited by examiner

*Primary Examiner*—William Hong
(74) *Attorney, Agent, or Firm*—Townsend and Townsend and Crew LLP

(57) ABSTRACT

The invention concerns a knife seat arrangement on a cutting shaft of a shredding machine, having a knife seat groove and cutting tool arranged therein, whereby the cutting tool, fastened so as to be detachable in the knife seat groove, adjoins a flat back surface on a flat front surface of a stop element and the stop element adjoins a corresponding end surface of the knife seat groove with a semicylindrical rear wall, whereby the stop element has a protrusion, situated in a form-locking manner in a corresponding recess of the groove bottom and directed inward, in the area of the groove bottom of the knife seat groove, said protrusion partially gripping under the cutting tool and adjoining it, so that the stop element is supported radially in the groove by the cutting tool. In addition, the invention concerns a knife seat arrangement in a shredding machine with knife seat recesses distributed about the periphery, spirally wound, whereby cutting tools can be placed in the knife seat recesses and a number of knife seat recesses are placed on a common radial shaft plane, so that several cutting tools are situated on a common, radial cutting tool flight circle, whereby, adjusted to the desired cutting force, the knife seat recesses of a common radial plane of the shaft are uniformly furnished with cutting tools and that knife seat recesses not furnished with cutting tools are covered or filled with cover elements.

37 Claims, 7 Drawing Sheets

ARRANGEMENT OF SEATS FOR KNIVES ON A CUTTING SHAFT IN A SHREDDING MACHINE

CROSS-REFERENCES TO RELATED APPLICATIONS

This application is a continuation application of U.S. patent application Ser. No. 09/310,496, filed on May 12, 1999, now abandoned, which claims priority to German Application Nos. 19821205.4 filed on May 12, 1998 and 19821207.0 filed on May 12, 1998.

BACKGROUND OF THE INVENTION

The invention concerns an arrangement of seats for knives on a cutting shaft in a shredding machine according to one embodiment.

A known shredding machine is shown in FIG. 16 and disclosed in DE 42 42 740 A1 and can be used to shred and reduce wood, metal parts, plastic material, garbage and other waste materials.

The shredder 101 essentially consists of a material hopper 102, a feed unit 103 and a cutting tool 104. The three machine components 102, 103, 104 are connected to one another so as to be detachable by flanged couplings and, when assembled, form a feeding chamber 105. In the feeding chamber 105, a cutting shaft 106 driven by an electromotor engages in the lower area opposite the feed unit 103. The cutting shaft 106 is octagonal or polygonal in shape and is equipped with a number of cutting tools 107. The cutting tools 107 are fastened to the cutting shaft 106 and spirally wound and distributed over the periphery and are engaged with a first cutting plate 108 and a second cutting plate being used as a scraping bar 109. The upper side of the first cutting plate 108 is simultaneously part of the floor of the feed chamber 105. A perforated screen 111 fastened to reinforcing rings 110 is provided below the cutting shaft 106. A collecting tray 112 is situated below the sieve 111, a worm conveyor 113 being connected to the lowest point of said collecting tray for removing the crushed or shredded material. FIG. 17 shows the cutting shaft 16 in a perspective of a partial view, as seen from the feed chamber 105. The cutting shaft 106 has a number of cutting tools 107 which are attached to the cutting shaft 106 in a thread-like manner. The cutting tools 107 sit in the recesses 129 made in the cutting shaft 106. The recesses 129 extend from a first edge 140 of the cutting shaft 106 to the second edge 141 following in direction of rotation. The base 142 of the recess 129 deepens uniformly relative to a cutting shaft surface 139 over its entire longitudinal extension. The base 142 or the supporting area 131 forms a right angle with the contact surface 130. The height of the contact surface 130 between the second edge 141 and the base 142 corresponds to the diagonal extension of a cutting tool 107.

A known shredding machine of this type is also shown in the brochure "Holzmag Zerkleinerungstechnik" [Holzmag Shredding Technology] of Holzmag AG. In particular, a polygonal rotor shaft is shown which has knife seats and cutting tools inserted into the knife seats. The cutting tools are blocks rhombic in cross-section which are arranged in essentially V-shaped grooves which are distributed about the periphery of the shaft. The grooves are made in the shaft with bevelled cutters, which is why the end of the groove found in the shaft has a semicircular shape. The cutting tools, which have a flat rhombic front surface and a flat rhombic back surface, require a flat emplacement on the back of the knives in order to ensure an impact resistant fit in the grooves. To this end, semicircular positioning elements are inserted into the semicircular or semicylindrical groove ends and welded with the material of the shaft.

A shredding machine of this type has proven successful.

In the field of waste recyling and disposal of waste materials, disposal firms must respond more and more flexibly to the various materials to be processed. Thus, for example, not only hard materials such as plastic housings, plastic products, electronic parts or other breakable materials have to be crushed but also stretch materials, woven synthetic materials, carpets, threads and fibers of all types. In addition, the material to be cut can vary considerably in size and volume; for example, small-sized hollow plastic bodies (PET bottles) and plastic barrels must be handled. Experience has shown that unsatisfactory results are obtained with respect to the cutting operation when using a preset driving power or the cutting shaft and a preset size for the cutting tools.

SUMMARY OF THE INVENTION

The object of the invention is to create an arrangement of seats for knives on a cutting shaft with which different demands with respect to the cutting operation of the cutting shaft can be easily met.

According to the invention, the groove for the knife seat is designed in a such a way that knife positioning elements can be loosely inserted in the rear end area of the groove and are loosely mounted. The knife positioning elements or stop elements are kept radially covered by the cutting tool screwed into the knife seat and, in addition, centered by the back of the cutting tool.

The positioning surface or the positioning element can have a contour protruding beyond the shaft, which is preferably adapted to the contour of the knife, so that the knife is supported by the positioning element over the entire rear surface of the knife.

The knife positioning elements according to the invention are, like the knives, easily and quickly exchangeable, so that they can be exchanged for other knives having knife positioning elements adapted accordingly. In addition, it is advantageous that, when there is a damaging impact stress on the knife which e.g. leads to a deformation of the knife seat, the knife positioning element can be exchanged because it is merely inserted in a corresponding recess of the shaft and is not welded with the shaft. As a result, the energy expended when changing the knife position is considerably reduced.

According to the invention, a cutting shaft can also be equipped in such a way that, at a preset maximum driving power, it can be optimally designed for the material to be shredded.

According to the invention, at a constant driving power, a cutting shaft can be adjusted to the material to be shredded in such a way that cutting tools can be removed at certain points from the cutting tools that are spirally wound and distributed on the periphery of the cutting shaft and replaced by cover elements of the invention which cover the knife seat in a lid-like manner. This enables a reduction or increase of the number of tools at a constant driving power of the cutting shaft, i.e. the torque of the cutting shaft is distributed to different numbers of knives and thus adapted to the material to be chopped. With difficult-to-shred materials, as e.g. carpets or woven plastics, the force on the individual cutting tools can be appropriately increased by reducing the tools, whereby the cover elements of the invention ensure that no chopped materials accumulate in the knife seats and contaminate the knife seats or that thread-like material to be chopped winds about the shaft in the area of the empty knife seats without being cut. With hard materials to be cut, the cover elements ensure that the grooves for the knife seats are not damaged.

The invention shall be described in the following by way of example and with reference to drawings.

DETAILED DESCRIPTION OF THE INVENTION

Figure 1:
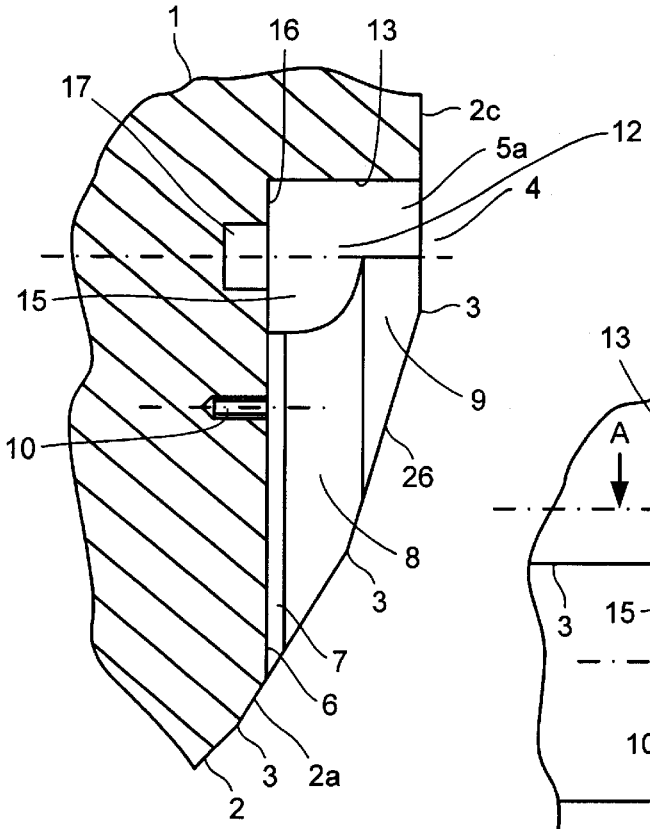
FIG. 1 illustrates the design of a knife seat groove according to one embodiment of the invention in a polygonal knife shaft in a sectional view through the shaft.
Figure 2:
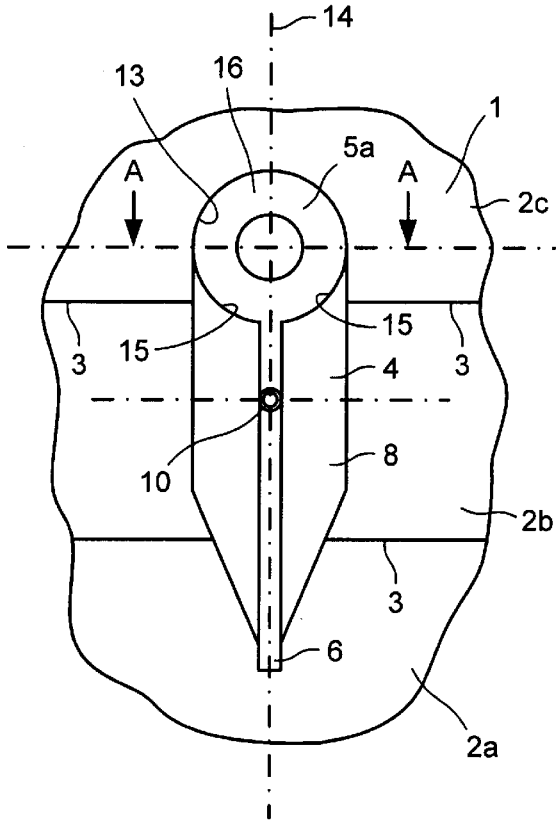
FIG. 2 illustrates a top view onto the knife seat groove according to FIG. 1.
Figure 3:
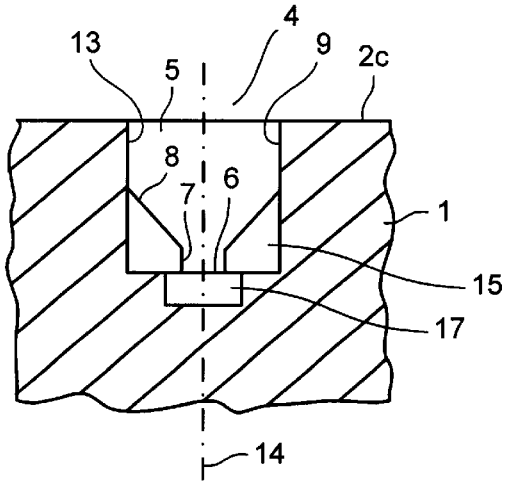
FIG. 3 illustrates a section along the line A—A in FIG. 2 through the knife seat groove.
Figure 4:
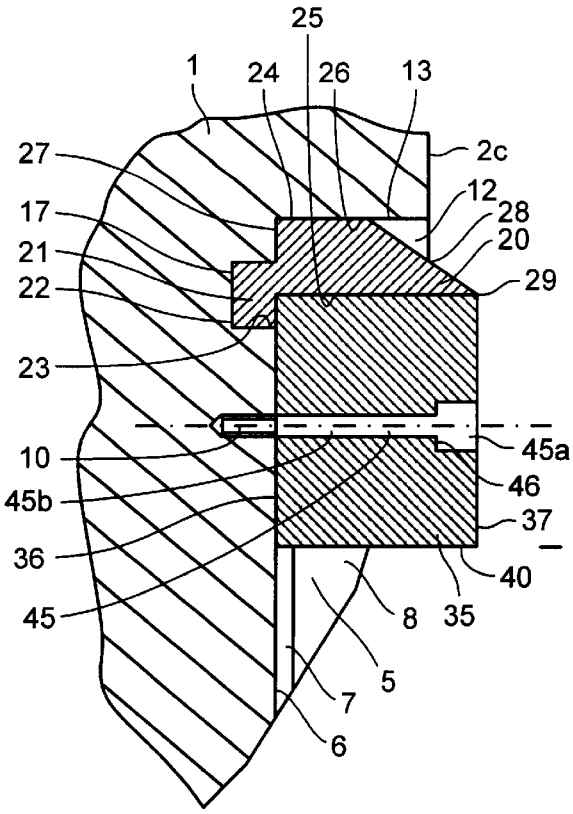
FIG. 4 illustrates a knife seat arrangement according to the invention having a knife positioning element and an inserted cutting tool in a section diagonal to the shaft.
Figure 5:
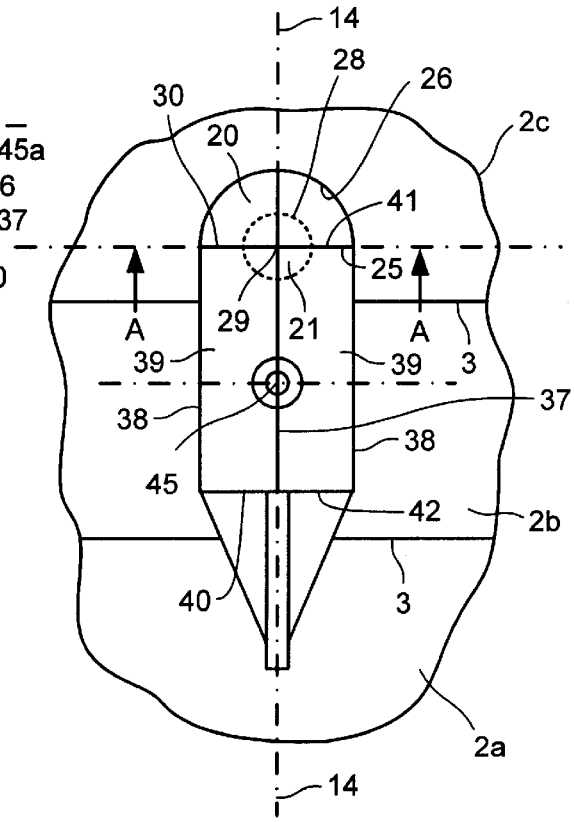
FIG. 5 illustrates the arrangement of FIG. 4 in a top view onto the shaft.
Figure 6:
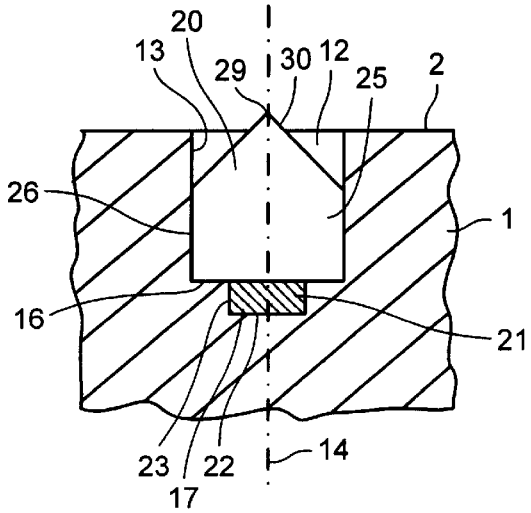
FIG. 6 illustrates the arrangement of FIG. 4 in a section along the line A—A in FIG. 1, in a top view onto the bearing surface of the knife positioning element.
Figure 7:
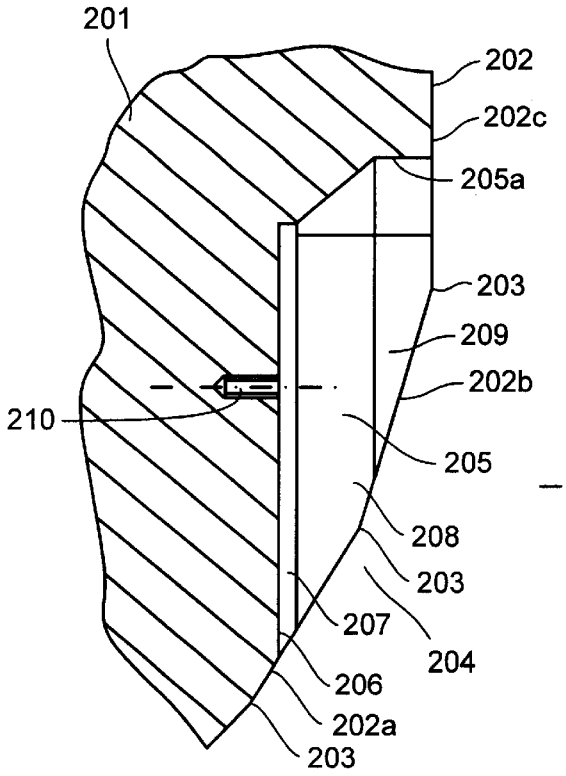
FIG. 7 illustrates a knife seat placed in a cutting shaft, in a longitudinal section diagonal to the longitudinal extension of the shaft.
Figure 8:
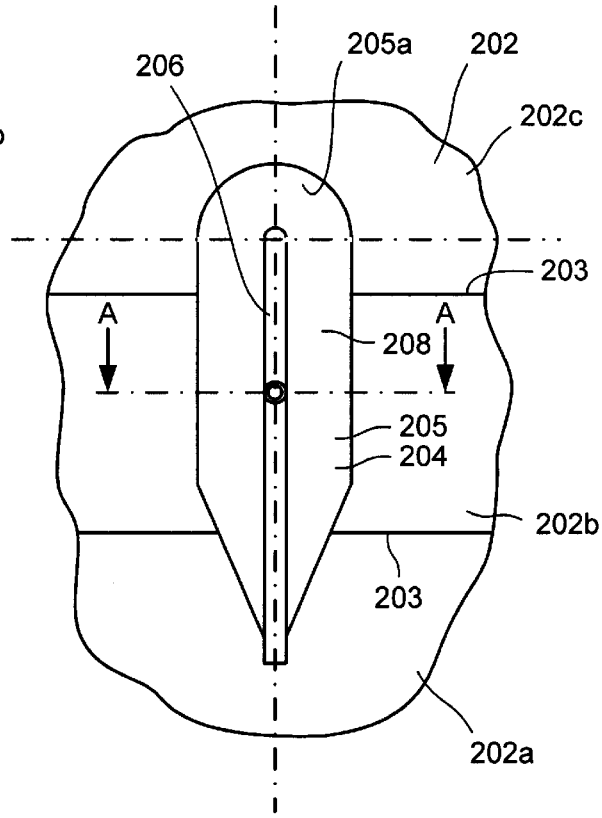
FIG. 8 illustrates a knife seat according to FIG. 7 in a top view.
Figure 9:
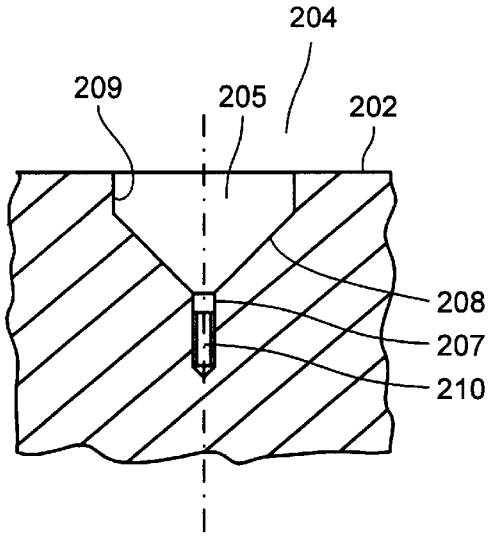
FIG. 9 illustrates a knife seat according to FIG. 7 in a section along line A—A in FIG. 8.
Figure 10:
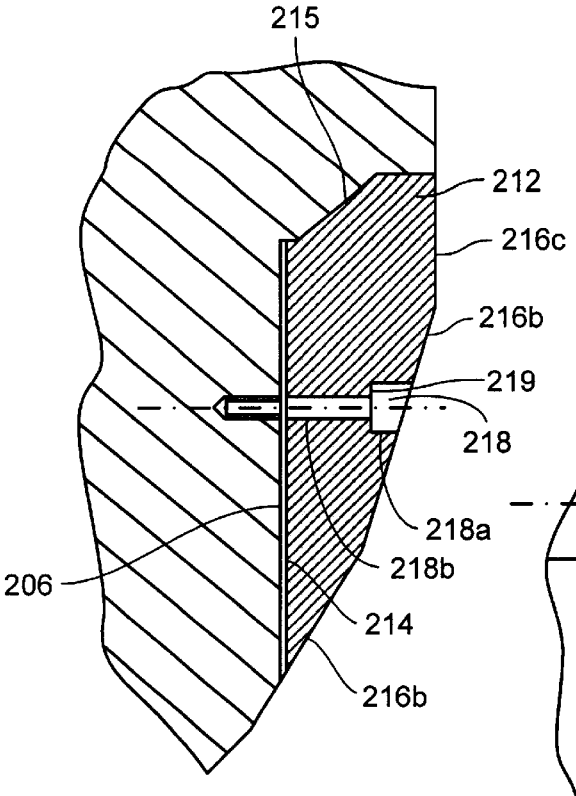
FIG. 10 illustrates a cover element according to the invention in a knife seat according to FIG. 7.
Figure 11:
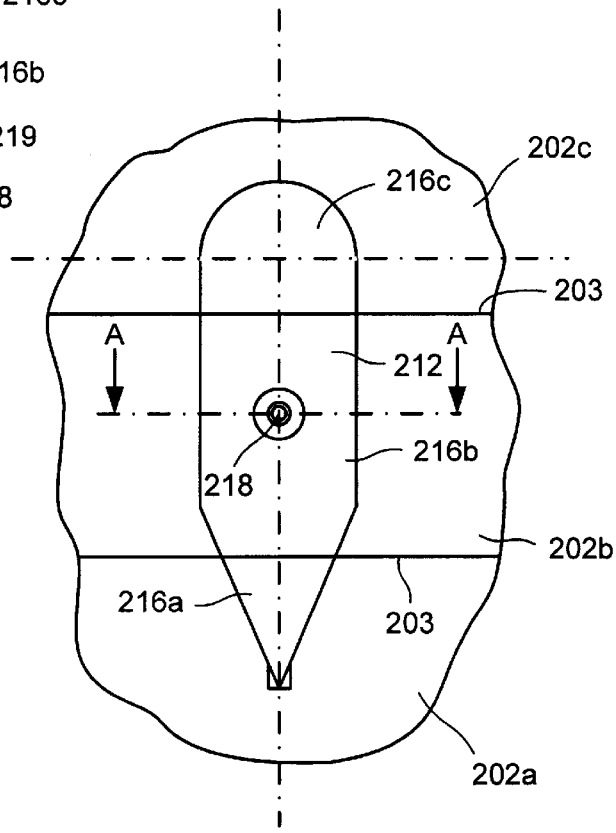
FIG. 11 illustrates a cover element of the invention in a knife seat according to FIG. 8.
Figure 12:
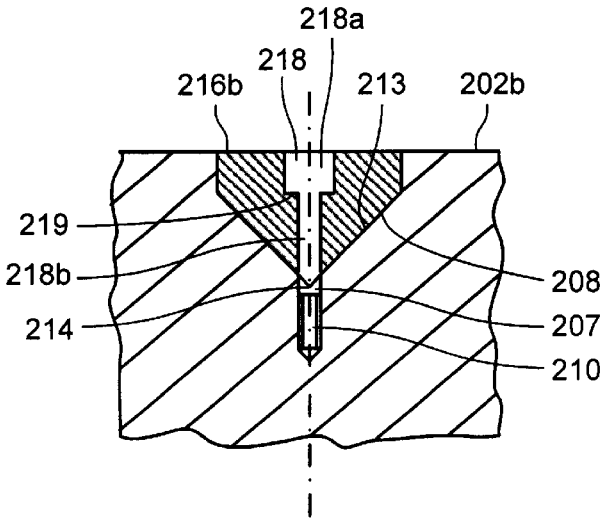
FIG. 12 illustrates a cover element of the invention in a knife seat in a section along line A—A in FIG. 11.
Figure 13:
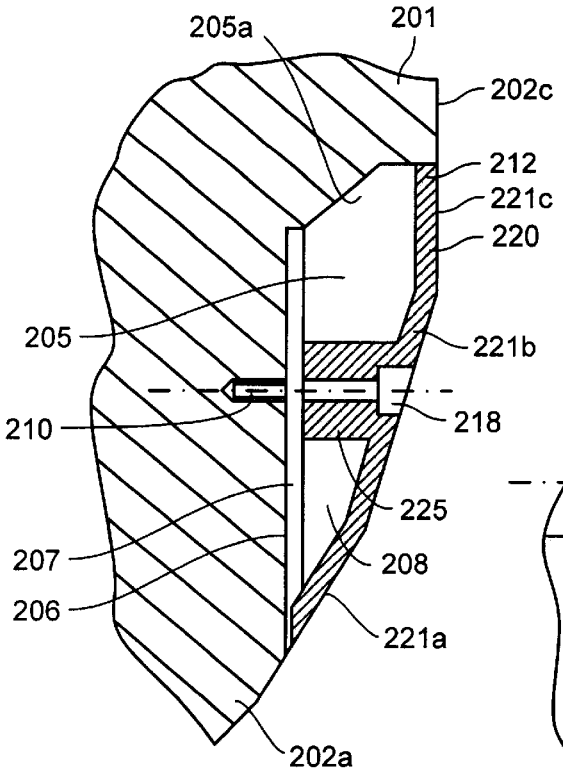
FIG. 13 illustrates a further embodiment of the cover element according to the invention in a knife seat according to FIG. 7.
Figure 14:
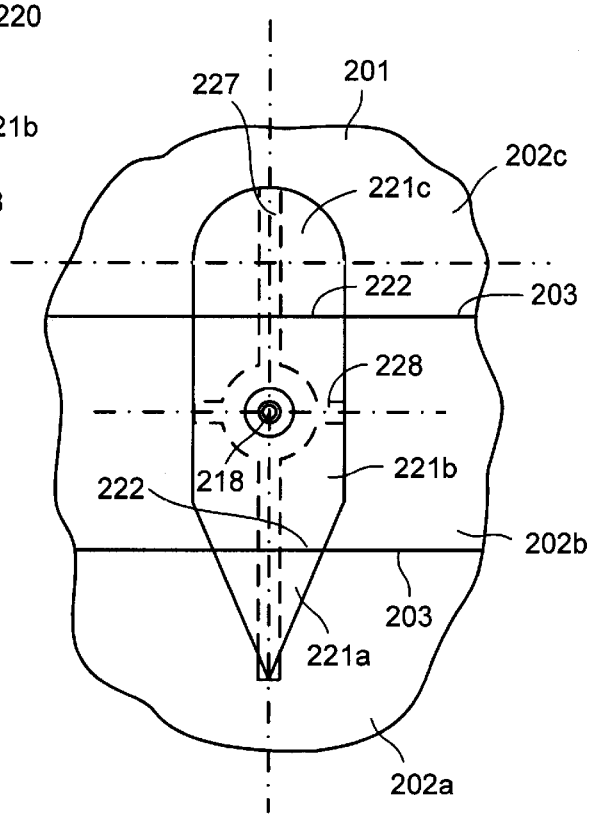
FIG. 14 illustrates a further embodiment of a cover element according to the invention as a hollow profile having reinforcing ribs in a knife seat as per FIG. 8.
Figure 15:
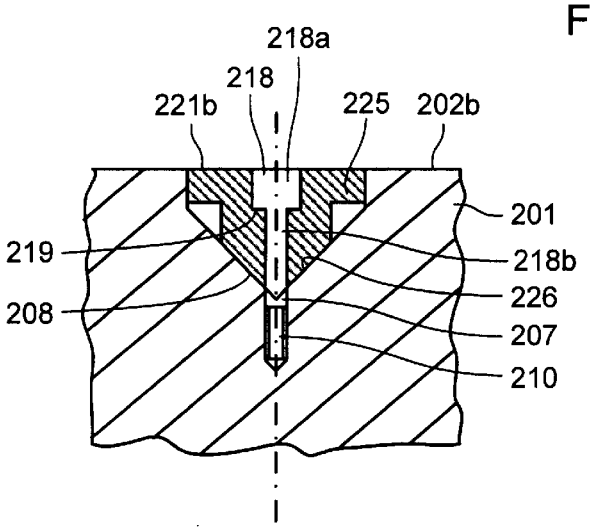
FIG. 15 illustrates a cover element according to the invention in a knife seat in a section along line A—A in FIG. 14.
Figure 16:
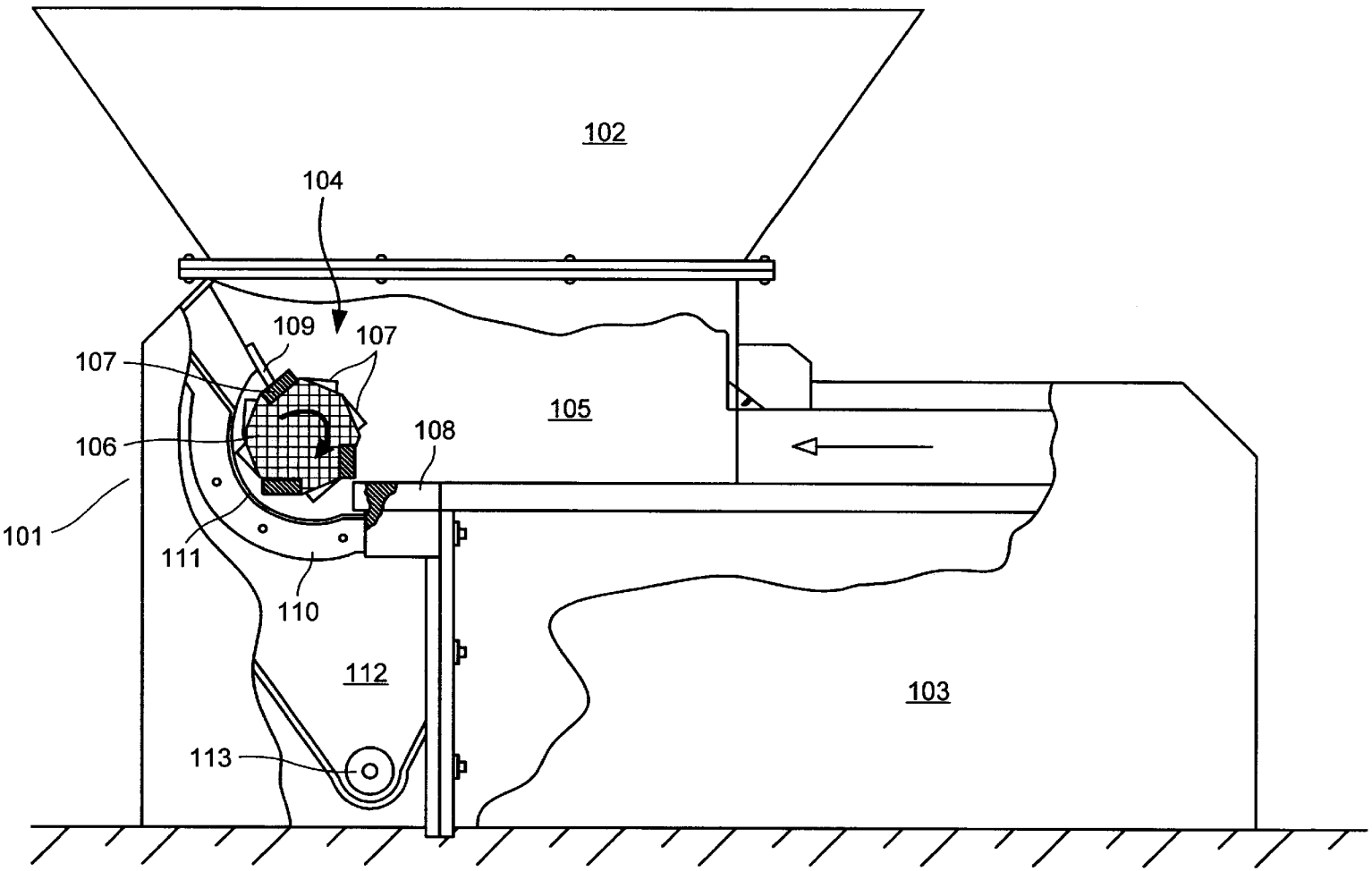
FIG. 16 (Prior Art)
FIG. 16 illustrates a known shredding machine having a cutting shaft and cutting tools attached thereto.
Figure 17:
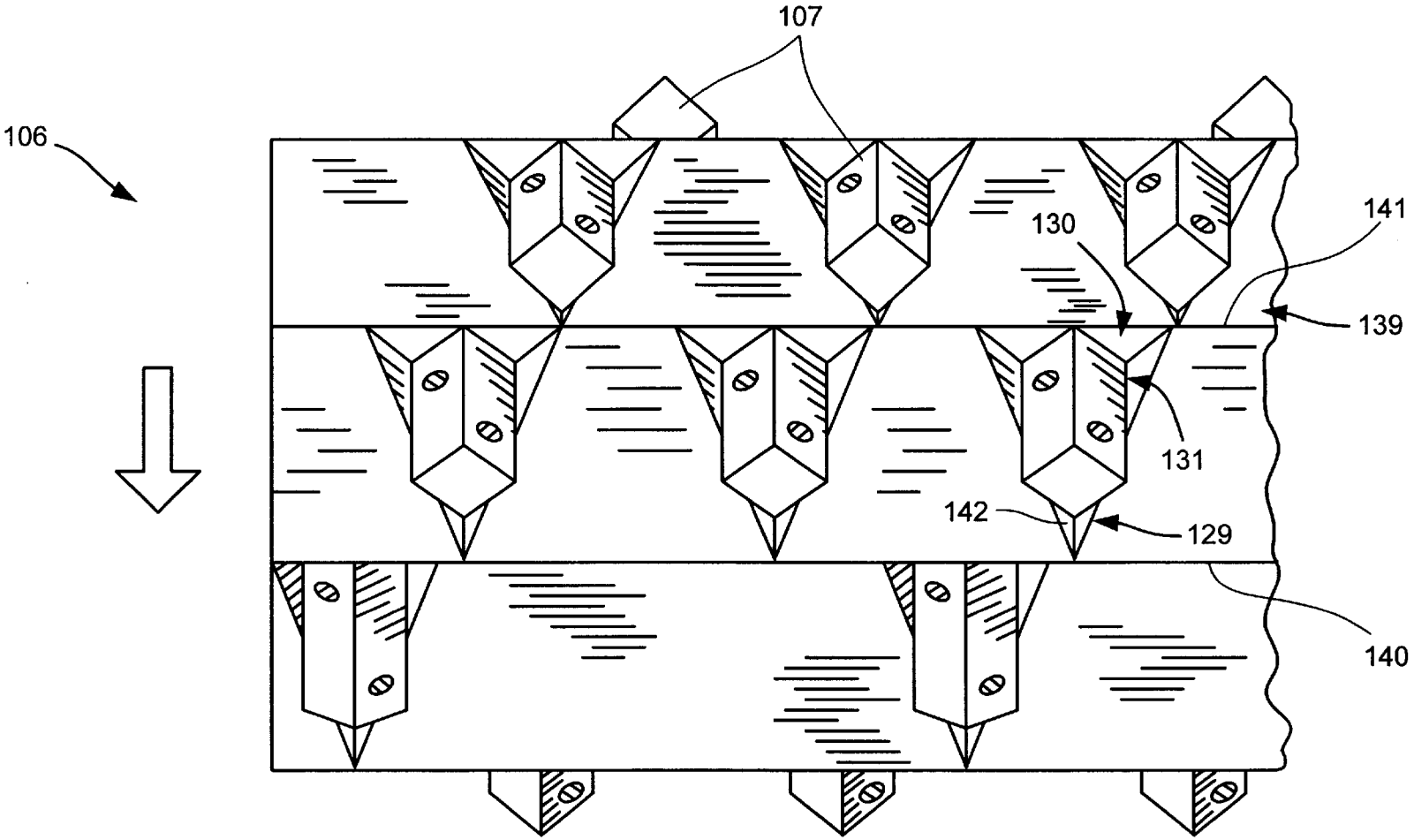
FIG. 17 (Prior Art)
FIG. 17 illustrates a cutting shaft of a shredding machine as per FIG. 16, in a top view.

A cutting shaft 1 (FIGS. 1 to 3) for accommodating cutting knives or cutting tools is, for example, a cutting shaft 1 having a polygonal cross section. Flat surfaces 2, which meet one another with edges 3, are formed by the polygonal cross section, whereby the edges 3 extend parallel to a longitudinal axis, preferably uniformly distributed about the periphery of the polygonal cutting shaft 1. Uniformly or regularly distributed knife seats 4 are mounted spirally wound on the periphery of the cutting shaft 1. The knife seats 4 are grooves 5 that are funnel-shaped in cross section with a flat groove bottom 6. The groove bottom 6 or the grooves 5 extend as hexagons from a surface 2 into the cutting shaft 1. The groove 5 begins at about the transverse axis of a surface 2*a*, and extends over the entire width of the next surface 2*b* and ends at approx. the transverse axis of the next surface 2*c* but one. Due to the hexagonal arrangement of the groove bottom 6, the groove 5 becomes deeper from the first surface 2*a* to the last surface 2*c*. The groove 5 which is funnel-shaped in cross section ends in the area of surface 2*c* with a semicylindrical rounded end 5*a*. In the conical area of the end 5*a*, the groove 5 has a flat groove bottom 6 and short walls 7 extending tangentially upward from the flat groove bottom 6, so that the groove 5 above the groove bottom 6 is a rectangular or square groove. The groove 5 expands with diagonal walls 8 from the short walls 7. Tangential straight walls 9 extend from the diagonal walls 8 to the surface of the cutting shaft 1 or the surface 2*c*. In the area of the surface 2*c*, the groove 5 has a constant height. The groove depth decreases successively from the edge 3 between the surface 2*c* and surface 2*b* to the edge 3 between the surface 2*b* and surface 2*a*, so that the height of the walls 9 of the groove 5 becomes less and less until the walls 9 disappear in the area of the edge 3 between surfaces 2*b* and 2*a*. The depth or height of the groove 5 continues to decrease from the edge 3 between the surface 2*b* and surface 2*a* to the emergence of the groove bottom 6 in the surface 2*a* and increasingly about the slope of surface 2*a* to surface 2*b*.

In the area of surface 2*b*, a bore 10 is placed in the groove bottom 6 at right angles to the groove bottom 6. The bore 10 serves to accommodate a setscrew (not shown) for cutting tools.

In the area of the end 5*a*, the groove 5 is formed from the upper surface 2*c* to the level of the groove bottom 6 as a cylindrical bore 12, so that the groove 5 has a semicylindrical wall 13 at right angles to the surface 2*c* in the area of end 5*a*. Adjacent to the walls 8, pointing in direction of the outlet of groove 5, cylinder casing sector-shaped walls 15 are formed on both sides of the transverse axis 14 of groove 5 and adjacent to wall 13. The flat groove bottom 6 opens at the end into a circular groove bottom 16. A cylindrical recess or bore 17 is placed in the bottom 16 so as to be axially aligned to the bore 12.

Referring to FIGS. 3–6, the stop element or positioning element 20 of the invention has a cylindrical foot plate 21 with a circular disk-shaped cylinder bottom wall 22 and a cylinder jacket wall 23. A semicylindrical section 24 of the element 20 extends from the foot plate 21 away from the foot plate 21. The semicylindrical section 24 has a flat front surface 25 and a casing wall or back surface 26 which is semicircular in cross section. The flat surface or wall 25 aligns with an axial plane of the foot plate 21, whereby the radius of the cylinder casing wall 26 is larger than the radius of the jacket wall 23 of the foot plate 21, so that the semicylindrical section 24 forming a step 27 protrudes beyond half of the cylindrical foot plate 21. The casing wall 26 of the semicylindrical section 24 tapers in from of a cone-shaped shell wall 28 up to a point 29, so that the flat wall 25 tapers via-à-vis the foot plate 21 in a inversed V-shaped manner to the point 29, forming an edge 30.

The foot plate 21 corresponds with the bore 17 and fits into it in a form-locking manner, at the top, it closes with the groove bottom 6. The casing wall 26 corresponds with the wall 13, so that the stop element 20 is disposed in the end area 5*a* of the groove 5, whereby the foot plate 21 rests in the bore 17 and the casing wall 26 adjoins the wall 13 in a form-locking manner. Step 27 rests in a form-locking manner on surface 16.

A cutting tool 35 to be placed in the groove 5 is a longitudinal block 35, rhombic in cross section, having a lower longitudinal edge 36 pointing into the groove 5, an upper longitudinal edge 37, two side longitudinal edges 38 and four surfaces 39 that have the same angle to one another. The rhombus forms a cutting tool face surface 40 pointing out of the groove 5 and a cutting tool rear surface 41 pointing toward the groove end 5*a*. The surfaces 39 and surface 40 form an inverse V-shaped cutting edge 42 that points outward. Extending from edge 37 to edge 36, a bore 45 is placed at about the longitudinal axis of the cutting tool 35, which has a wide bore area 45*a* in the vicinity of edge 27 that becomes narrower with a step 46 to form a narrower bore area 45*b*.

The arrangement of the stop element 20 and a cutting tool 35 in a groove 5 or in a knife seat 4 will be described in the following. First, the stop element 20 is inserted into the bore 17 with the foot plate 21, so that the cylinder casing wall 26 of area 24 adjoins the wall 13. A cutting tool 35 is then pushed into the groove 5 until the cutting tool surface 41 or rear knife surface adjoins surface 25 in a form-locking manner. The cutting tool 35 lies on the surfaces 8 of the groove 5 and, with the longitudinal edge 36, on the groove bottom 6 and, at the top, on the foot plate 21, radially covering the latter. A screw bolt (not shown) is then inserted through the bore or the hole 45 and then screwed into the bore 10 of the cutting shaft 1 which is aligned with the bore 45. By fastening the cutting tools 35 to the cutting shaft 1, the stop element 20 is also fastened to the cutting shaft 1 due to the pressure of the longitudinal edge 36 on the foot plate 21. The edge 30 of the stop element 20 closes with the surfaces 39 and the upper longitudinal edge 37 of the cutting tool 35.

In a further embodiment, the upper side of the footplate 21 is designed V-shaped, protruding beyond the groove bottom 6, whereby the groove bottom 6 horizontally aligns or seals with the base of the V-shaped protrusion. In this embodiment, the footplate 21 holohedrally adjoins the lower diagonal surfaces and the edge 36 of a cutting tool 35 in a form-locking manner. As a result, a centering or alignment of the stop element 20 is obtained when the cutting tool 35 is inserted.

If the surfaces 39 of the cutting tool 35 are contoured, for example, contoured with teeth that point outward, the edge 30 of the stop element 20 can be formed accordingly, so that the cutting tool 35 is holohedrally supported by the stop element 20 in the area of the surface 39 adjacent to the longitudinal edge 37.

The stop element 20 can, adjusted to the material of the cutting tool 35, consist of hard metal, metal, ceramics or the like. In addition, various stop elements 20 can be used for different cutting contours of the cutting tools 35, which are exchanged when the knives are exchanged. Furthermore, protrusions can be formed on the rear surface 26 of the stop element 20, said protrusions fitting in appropriate corresponding recesses of the rounded end wall 13 of the groove 5, so that the stop elements 20 are hereby radially secured.

If the number of cutting tools 35 on the cutting shaft 1 is reduced, the setscrew is unscrewed and the cutting tool 35 removed. The stop element 20 is then removed, after which a cover piece (not shown) is pushed onto the empty groove 5 or into the empty knife seat 4 and screwed in the bore 10.

In the design of a knife seat 4 according to the invention and the stop elements 20 of the invention, it is advantageous that the stop elements can be easily removed. As a result, the stop elements 20 can be easily removed when there is damage. In addition, the stop elements 20 can be adjusted to the various forms of the cutting tool 35 or materials and be inserted together with the knives. Furthermore, it is advantageous that the stop elements 20 do not have to be unwelded after damage has occurred.

In the embodiment of the invention according to FIGS. 7 to 15, a cutting shaft 201, for example a cutting shaft 201 having a polygonal cross section, is shown for accommodating cutting knives or cutting tools. Due to the polygonal cross section, flat surfaces 202 are formed which meet at their edges 203, whereby the edges 203, extending parallel to a longitudinal axis of the shaft 201, are preferably uniformly distributed on the polygonal cutting shaft 201. Uniformly or regularly distributed knife seats 204, wound spirally, are placed on the periphery of the cutting shaft 201. The knife seats 204 are grooves 205, funnel-shaped in cross section with a flat groove bottom 206. The groove bottom 206 or the grooves 205 extend as hexagons from a surface 202 into the cutting shaft 201. The groove 205 begins at about the transverse axis of a surface 202*a*, extends over the entire width of the next surface 202*b* and ends approx. at the transverse axis of the next surface 202*c* but one. Due to the hexagonal arrangement of the groove bottom 206, the groove 205 becomes deeper from the first surface 202*a* to the final surface 202*c*. The groove 205, funnel-shaped in cross section, ends in the area of the surface 202*c* with a semi-tapered funnel-shaped, rounded end 205*a*. The groove 205 has the flat groove bottom 206 and short walls 207 extending tangentially upward from the flat groove bottom 206 in this area, so that the groove 205 is a rectangular or square groove above the groove bottom 206. The groove 205 expands from the short walls 207 with diagonal walls 208. Straight walls 209 extend tangentially from the diagonal walls 208 to the surface of the cutting shaft 201 or surface 202*c*. In the area of surface 202*c*, the groove 205 has a constant height. The groove depth declines successively from the edge 203 between the surface 202*c* and surface 202*b* to the edge 203 between the surface 202*b* and surface 202*a* and increasingly declines from edge 203 between surface 202*b* and surface 202*a* to the bottom of the groove where the groove ends at surface 202*a*, again by the slope of surface 202*a* to surface 202*b*.

The diagonal walls 208 serve as bearings for cutting tools. In the area of surface 202*b*, a bore 210 is placed in the groove bottom 206 at right angles to the groove bottom 206. The bore 210 serves to accommodate a setscrew for cutting tools.

The cover element 212 of the invention (FIGS. 10 to 12) is solid, e.g. made of metal or a ceramic, and points to walls 213 corresponding to the diagonal walls 208 which meet at a common edge 214. When the cover element 212 is placed in the groove 205, the edge 214 is situated between the short walls 207 and is preferably slightly spaced from the groove bottom 206. The remaining surfaces of the cover element 212 correspond to the groove 205, so that the cover element 212 is made so as to be in the shape of a semicircular cone end 215 in the area of a surface 202*c* or the groove end 205*a* and tapers from the semicircular conically shaped end 215 along the groove 205, whereby the cover element 212 has surfaces 216*a*, 216*b* and 216*c* pointing outward and oriented at an angle to one another, which each align or close with the surfaces 202*a*, 202*b* and 202*c* of the polygonal cutting shaft 201.

Aligned with the bore 210, the cover element 212 has a bore 218 made in the cover element from the surface 216*b* at a right angle to the edge 214 and which becomes narrower from a further area 218*a* with a step 219 to a narrower area 218*b*. A threaded bolt is inserted through the bore 218 or hole 18 and screwed into the threaded bore 210 of the shaft 201 in order to rigidly fix the cover element 212 in the groove 205.

In a further embodiment of the cover element 212 (FIGS. 13 to 15), the cover element 212 is shaped like a hollow profile in the form of a plate 220 that is bent twice, whereby three surfaces 221*a*, 221*b* and 221*c* are formed by the bending, which meet at the crease edges 222. The outer form of the plate 220 corresponds to the form of the groove 205 or the shaft 201, adjacent to the surfaces 202*a*, 202*b*, 202*c*, so that, when the cover element 212 has been pushed into the groove 205, the plate 220 seals in a form-locking manner on the outside.

The plate 220 has a cylindrical formation 225 in direction of the bore 210 in the groove bottom 206 which is formed, in the area of the diagonal walls 208 of the groove 205, with diagonal supporting walls 226 corresponding to the walls 208. A bore 218 for accommodating a screw bolt is also placed in this plate 220 in the area of the formation 225. In a further embodiment (FIG. 14), a reinforcing rib 227 is situated on the underside and a transverse reinforcing rib 228 diagonally thereto, following the longitudinal slope of the cover element 212.

The use of the cover element is described in the following.

In order to apply an increased force on the individual cutting tools at a preset driving power and the constant speed of the cutting shaft, it is necessary to reduce the number of knives. Usually several cutting tools, e.g. up to eight, are found on a cutting tool flight circle or a common, radial plane of the shaft with cutting tools generally spirally wound and distributed over the periphery, so that during a rotation of the shaft a cut is made eight times in this flight circle. The number of knives can, for example, be halved on a knife flight circle, so that only four cuts are made during a rotation. The empty four knife seats or grooves are covered with the cover element of the invention, whereby it is advantageous that the cover elements prevent material from accumulating in the groove or prevent difficult-to-cut material, such as e.g. carpets, from catching on empty grooves 205 and winding about the shaft without being cut. With hard material to be cut, the cover elements prevent the knife seat grooves not equipped with knives from being damaged by the plate 220 seals in a form-locking manner on the outside.

The plate 220 has a cylindrical formation 225 in direction of the bore 210 in the groove bottom 206 which is formed, in the area of the diagonal walls 208 of the groove 205, with diagonal supporting walls 226 corresponding to the walls 208. A bore 218 for accommodating a screw bolt is also placed in this plate 220 in the area of the formation 225. In a further embodiment (FIG. 15), a reinforcing rib 227 is situated on the underside and a transverse reinforcing rib 228 diagonally thereto, following the longitudinal slope of the cover element 212.

The use of the cover element is described in the following.

In order to apply an increased force on the individual cutting tools at a preset driving power and the constant speed of the cutting shaft, it is necessary to reduce the number of knives. Usually several cutting tools, e.g. up to eight, are found on a cutting tool flight circle or a common, radial plane of the shaft with cutting tools generally spirally wound and distributed over the periphery, so that during a rotation of the shaft a cut is made eight times in this flight circle. The number of knives can, for example, be halved on a knife flight circle, so that only four cuts are made during a rotation. The empty four knife seats or grooves are covered with the cover element of the invention, whereby it is advantageous that the cover elements prevent material from accumulating in the groove or prevent difficult-to-cut material, such as e.g. carpets, from catching on empty grooves 205 and winding about the shaft without being cut. With hard material to be cut, the cover elements prevent the knife seat grooves not equipped with knives from being damaged by the materials. Moreover, it is advantageous that the cover element can be manufactured in an especially simple and easy manner, for example, by metal casting.

By providing cover elements, it is thus possible to quickly refit a conventional cutting shaft to various types of materials. As a result of the form of the cover element corresponding to the groove and the fastening of the cover element with a screw connection equivalent to the knives, the refitting can be easily and especially quickly obtained.

What is claimed is:

1. A knife seat arrangement on a cutting shaft of a shredding machine comprising:

a knife seat groove comprising a groove bottom, an end surface, and a recess;

a cutting tool fastened in the knife seat groove comprising a flat back surface, wherein the cutting tool is detachable from the knife seat groove;

a stop element comprising a semicylindrical rear wall, a protrusion in the area of the groove bottom directed into the cutting shaft, and a flat front surface, wherein the flat front surface adjoins the flat back surface and the semicylindrical rear wall adjoins the end surface, wherein the protrusion is situated in a form-locking manner in the recess partially gripping under the cutting tool and adjoining the cutting tool where the stop element is radially supported by the cutting tool in the knife seat groove.

2. The knife seat arrangement according to claim 1, wherein the protrusion of the stop element is a cylindrical foot plate having a circular cylindrical bottom wall and a cylindrical casing wall.

3. The knife seat arrangement according to claim 2, wherein the semicylindrical section of the stop element extends over a back half of the foot plate, wherein the semicylindrical section includes a flat front surface and a rear surface that is semicircular in cross section.

4. The knife seat arrangement according to claim 3, wherein the rear surface comprises a casing wall.

5. The knife seat arrangement according to claim 3, wherein the flat front surface aligns with an axial plane of the foot plate, wherein the radius of the rear surface is larger than the radius of the cylindrical casing wall of the foot plate, wherein the semicylindrical section projects beyond half of the cylindrical foot plate, forming a step.

6. The knife seat arrangement claim 5, wherein the rear surface of the semicylindrical section tapers in the form of a conical casing wall to a point vis-á-vis the foot plate, wherein the flat wall tapers vis-á-vis is the foot plate in an inverted V-shape to the point, forming an edge.

7. The knife seat arrangement according to claim 5, further comprising a cylindrical bore of the knife seat groove, wherein the foot plate rests in the cylindrical bore of the knife seat groove so as to be form-locked and detachable.

8. The knife seat arrangement according to claim 5, further comprising a groove wall, wherein the step adjoins the groove wall in a form-locking manner on a surface of the rear surface.

9. The knife seat arrangement according to claim 1, wherein the cutting tool is an elongated block, rhombic in cross section, and includes a lower longitudinal edge pointing to the groove bottom of the knife seat groove, an upper longitudinal edge, two side longitudinal edges, a cutting tool front surface, and a cutting tool back surface, wherein the lower longitudinal edge rests on the groove bottom and on the protrusion at the top.

10. The knife seat arrangement according to claim 9, further comprising a V-shaped groove of the protrusion underneath the cutting tool, wherein the V-shaped groove protrudes beyond the level of the groove bottom of the knife seat groove and is designed where the foot plate adjoins a plurality of lower diagonal surfaces and the lower longitudinal edge of a cutting tool in a form-locking manner over the entire surface at the top.

11. The knife seat arrangement according to claim 9, wherein the stop element comprises an edge, wherein the edge closes with upper surfaces of the cutting tool adjacent to the upper longitudinal edge.

12. The knife seat arrangement according to claim 11, wherein the upper surfaces are contoured.

13. The knife seat arrangement according to claim 12, wherein the edge of the stop element has the same contour as the contoured upper surfaces of the cutting tool and the edge closes with the contoured surfaces of the cutting tool.

14. The knife seat arrangement according to claim 1, wherein the flat front surface of the stop element adjoins the flat back surface of the cutting tool over the entire surface.

15. The knife seat arrangement according to claim 1, wherein the stop element comprises a hard metal, metal, ceramics or synthetic materials.

16. The knife seat arrangement according to claim 1, wherein the step element comprises a back surface that engages with a corresponding groove wall.

17. A knife seat arrangement on a cutting shaft of a shredding machine comprising:

a plurality of knife seat grooves wherein each knife seat groove comprises a groove bottom, an end surface, and a knife seat recess;

a plurality of cutting tools fastened in at least one knife seat groove of the plurality of knife seat grooves, wherein each cutting tool comprises a flat back surface, wherein the plurality of cutting tools are detachable from the plurality of knife seat grooves;

a plurality of stop elements wherein each stop element comprises a semicylindrical rear wall, a protrusion in the area of the groove bottom directed into the cutting shaft, and a flat front surface, wherein the flat front surface adjoins the flat back surface and the semicylindrical rear wall adjoins the end surface, wherein the protrusion is situated in a form-locking manner in the knife seat recess of each knife seat groove partially gripping under each cutting tool and adjoining each cutting tool where each stop element is radially supported by each cutting tool in each knife seat groove;

a plurality of cover elements secured in a lid-like manner in at least one knife seat groove in the plurality of knife seat grooves where the plurality of cutting tools are not fastened in the plurality of knife seat grooves.

18. The knife seat arrangement according to claim 17, wherein the plurality of knife seat recesses are V-shaped grooves.

19. The knife seat arrangement according to claim 17, wherein the cover element comprises a formation to obtain a closed form with wall areas forming the groove and a surface pointing outward that corresponds to the contour of the cutting shaft in the area of the V-shaped grooves and closes with the surface of the cutting shaft.

20. The knife seat arrangement according to claim 19, wherein the formation comprises a wall.

21. The knife seat arrangement according to claim 19, wherein the formation comprises a cylindrical formation.

22. The knife seat arrangement according to claim 19, wherein the cutting shaft is polygonal.

23. The knife seat arrangement according to claim 22, wherein the surface of the cover element is formed with first, second, and third flat surfaces at an angle to one another, which close with the surface of the cutting shaft at an angle to one another of the polygonal cutting shaft.

24. The knife seat arrangement according to claim 22, wherein the polygonal cutting shaft comprises a plurality of flat surfaces that are at an angle to one another.

25. The knife seat arrangement according to claim 19, wherein the knife seat recess is a groove funnel-shaped in cross section and the groove bottom is flat, wherein the flat groove bottom and the groove are arranged as hexagons extending from the surface of the cutting shaft into the cutting shaft.

26. The knife seat arrangement according to claim 25, wherein the surface of the cutting shaft comprises first, second, and third surfaces, wherein the groove starts a transverse axis of the first surface, extends over the entire width of the second surface, opposite the direction of rotation, and ends at about a transverse axis of the third surface but one in direction of rotation.

27. The knife seat arrangement according to claim 26, wherein the groove extends hexagonally to a longitudinal axis of the polygonal cutting shaft from the first surface of the polygonal cutting shaft to the third surface in whose area the groove ends and deepens.

28. The knife seat arrangement according to claim 27, wherein the groove comprises a funnel-shaped cross section that ends with a semi-conical funnel-shaped rounded end in the area of the third surface.

29. The knife seat arrangement according to claim 28, wherein the groove comprises an end and a plurality of short walls, wherein the flat groove bottom is in the area of the end and the plurality of short walls, wherein the end and plurality of short walls extend from the flat groove bottom at right angles to the surface of the cutting shaft and to the flat groove bottom, so that the groove has a rectangular or square groove shape above the flat groove bottom.

30. The knife seat arrangement according to claim 29, wherein the groove comprises a plurality of diagonal walls, wherein the plurality of diagonal walls extend outward from the plurality of short walls, wherein the plurality of diagonal walls are bearing surfaces for plurality of cutting tools and plurality of cover elements.

31. The knife seat arrangement according to claim 30, further comprising a plurality of tangential straight walls that extend from the plurality of diagonal walls to the surface of the cutting shaft and the third surface.

32. The knife seat arrangement according to claim 30, wherein the groove in the area of the first surface has a constant height, wherein a depth of the groove declines from an edge between the third surface and the second surface successively to the edge between the second surface and the first surface and that the groove depth declines more intensely until the flat groove bottom ends on the first surface from the edge between the second surface and first surface, by the slope of the first surface to second surface.

33. The knife seat arrangement according to claim 32, wherein the bore is placed in the bottom of the groove at a right angle to the flat groove bottom in the area of the second surface.

34. The knife seat arrangement according to claim 17, wherein the plurality of cover elements are solid, filling the plurality of knife seat grooves substantially completely.

35. The knife seat arrangement according to claim 17 wherein the cover element comprises metal, ceramics, and synthetic materials.

36. The knife seat arrangement according claim 17, wherein the cover element comprises a bore placed radially in the cover element with respect to the arrangement of the cover element on the cutting shaft.

37. The knife seat arrangement according to claim 17, characterized therein that the cover element is in the form of a hollow profile comprising a plate closing the shaft with the outer surface, wherein the formation is provided on the plate where the plate supports itself in the groove on the surfaces defining the groove.

* * * * *